US005282739A

United States Patent [19]

Chinsky et al.

[11] Patent Number: 5,282,739

[45] Date of Patent: Feb. 1, 1994

[54] SAFETY DEVICE FOR GAS-FIRED EQUIPMENT

[76] Inventors: Moshe Chinsky, 3 Haviva Reich Str., Ramat-Gan, Israel; Elazar Eyal (Bickels), 26 Michal Street, Tel-Aviv, Israel, 61 460

[21] Appl. No.: 960,730

[22] Filed: Oct. 14, 1992

[30] Foreign Application Priority Data

Oct. 30, 1991 [IL] Israel ..... 99903

[51] Int. Cl.[5] ..... F23Q 9/08

[52] U.S. Cl. ..... 431/51; 431/69

[58] Field of Search ..... 431/69, 42, 51

[56] References Cited

U.S. PATENT DOCUMENTS 3,280,884 10/1966 Eckelberry et al. ..... 431/75
3,797,988 3/1974 Davidson ..... 431/75 X
5,161,963 11/1992 Berlincourt .

*Primary Examiner*—William E. Wayner

*Attorney, Agent, or Firm*—Darby & Darby

[57] ABSTRACT

A safety device for gas-fired equipment having a main gas supply control valve and a plurality of gas-taps each associated with a flame-producing burner. The device includes a plurality of switches each associated with a gas-tap and actuatable by the operation of the gas-tap, a plurality of heat responsive sensors each having a switching circuit operationally connected in circuit with a secondary control circuit and a timer, and a central control unit connected in circuit for receiving control signals from the output of each of the secondary control circuits, thereby controlling the state of the main gas supply valve. Upon the detection by a heat responsive sensor of the extinction of a fire from a burner when a gas-tap associated therewith is open, after a predetermined time period, the secondary control circuit connected to the sensor emits a signal to the central control unit for effecting the closing of the main gas supply valve.

9 Claims, 4 Drawing Sheets

SAFETY DEVICE FOR GAS-FIRED EQUIPMENT

BACKGROUND OF THE INVENTION

The present invention relates to a safety device for gas-fired equipment such as kitchen ranges, baking ovens, heating stoves, gas-powered engines, and the like.

The great, and deserved, popularity of gas as a domestic, as well as industrial, fuel tends to make people forget its dangerous nature which lies less in its toxicity, but in its explosiveness. In fact, the destructive effect of exploding stoichiometric or near-stoichiometric gas/air mixtures rivals that of high explosives. Although such mixtures may be produced by slow leaks from cracked pipes and faulty joints, they are most frequently the result of burner flames being accidentally extinguished by gusts of wind or, more often, by boiling-over kettles and pots, permitting relatively large quantities of gas to escape within a relatively short period of time. Existing safety devices are based on mechanical action produced in or near the combustion zone by heat-sensitive elements, and used with the aid of mechanical linkage members, to control valves. These members are exposed to the corrosive fretting effects of heat and combustion gases on the one hand, and to the interference of sticky, resinous cooking or baking residues, on the other, and become progressively unreliable. Furthermore, none of these devices will give protection against rupture of the supply line at any point between meter (or bottle) and burner.

OBJECTS OFF THE INVENTION

It is therefore, one of the objects of the present invention to remedy the present situation and to provide a safety device with long-term reliability that is suitable for all types of gas-fire equipment including kitchen ranges with one or more burners.

It is a further object of the invention to provide a safety device that uses no mechanical components near the combustion zone that are liable to stick or jam and that employs an electromagnetic main valve mountable also at a distance from the equipment it is associated with, thus also offering protection in the above-mentioned cases of line rupture.

BRIEF DESCRIPTION OF THE INVENTION

In accordance with the invention there is provided a safety device for gas-fired equipment having a main gas supply control valve and a plurality of gas-taps each associated with a flame-producing burner, said device comprising a plurality of switch means each associated with a gas-tap and actuatable by the operation of said gas-tap, a plurality of heat responsive sensors each including a switching circuit operationally connected in circuit with a secondary control circuit and a timer, and a central control unit connected in circuit for receiving control signals from the output of each of the secondary control circuits, thereby controlling the state of said main gas supply valve, the arrangement being such that upon the detection by a heat responsive sensor of the extinction of a fire from a burner when a gas-tap associated therewith is open, after a predetermined time period, said secondary control circuit connected to said sensor emits a signal to said central control unit for effecting the closing of said main gas supply valve.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

Figure 1A:
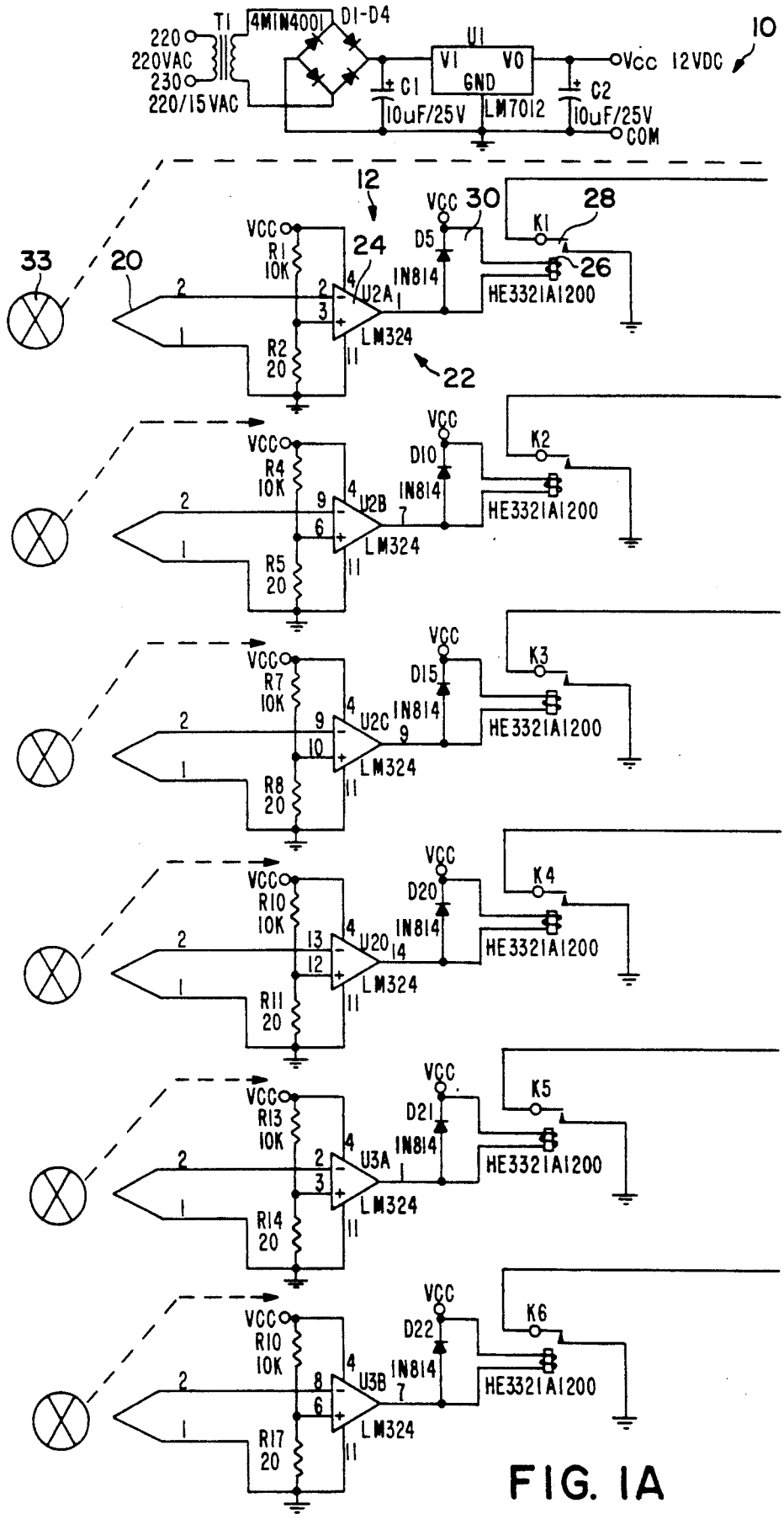
Figure 1B:
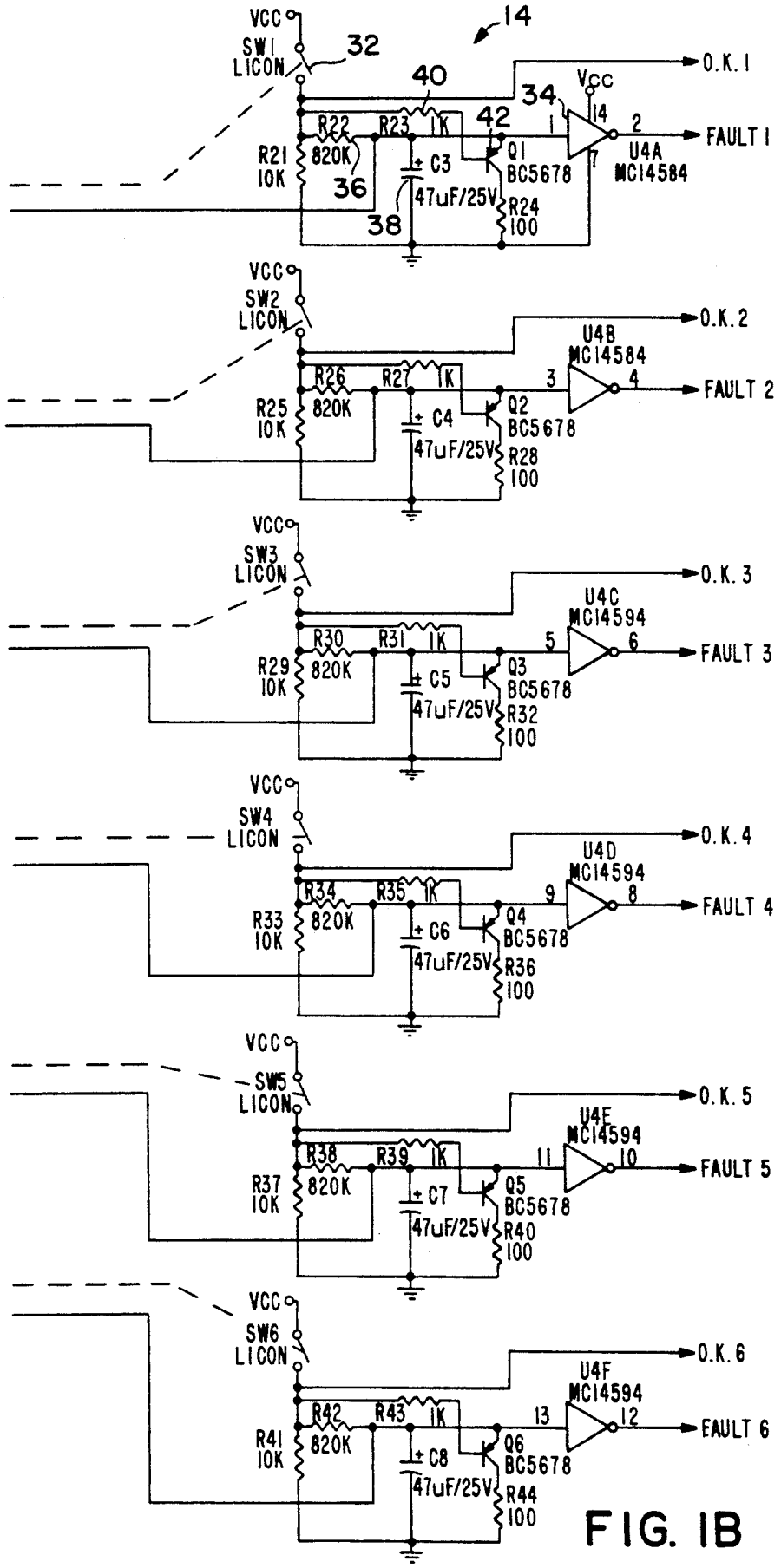
Figure 1C:
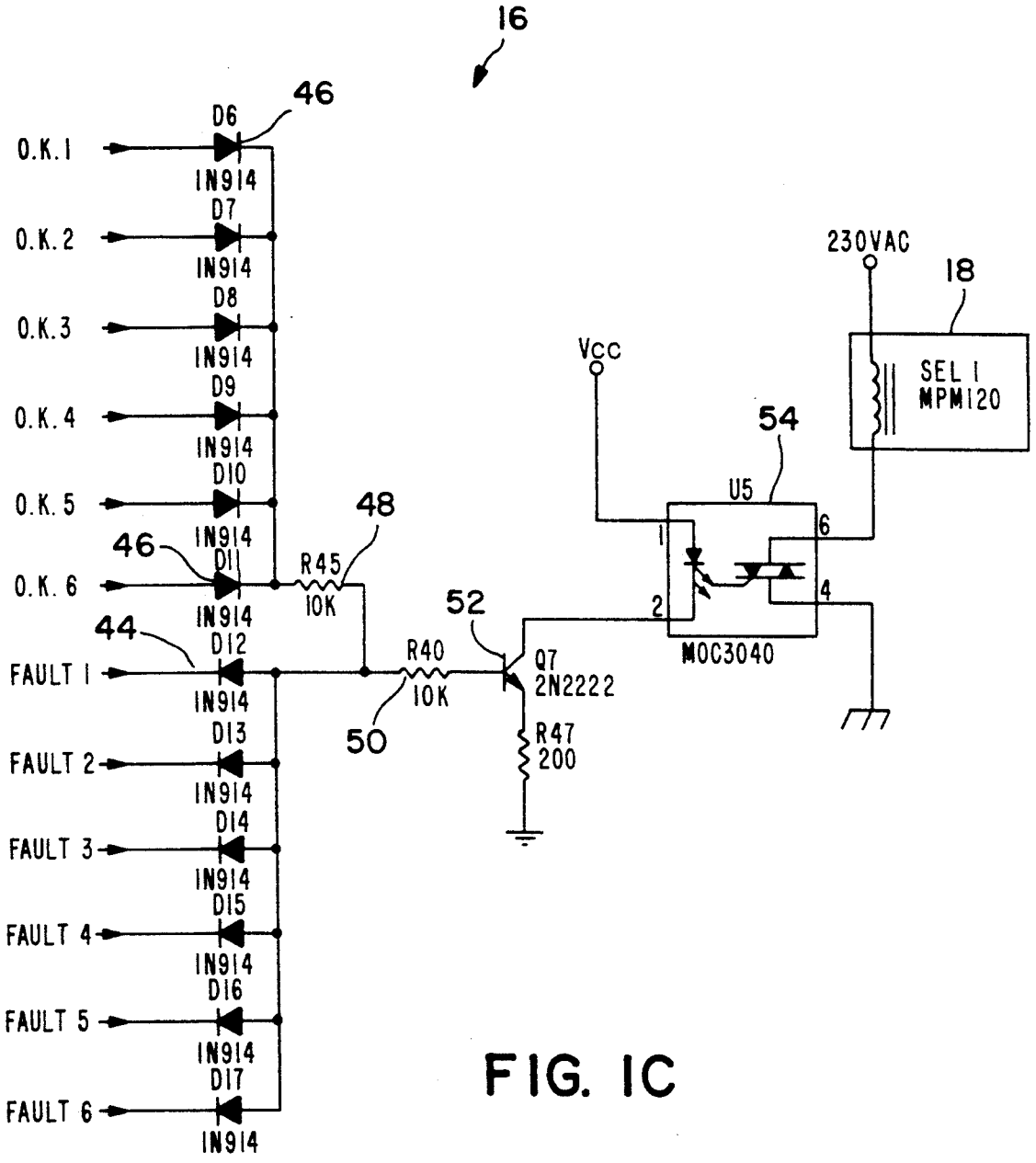
Figure 2:
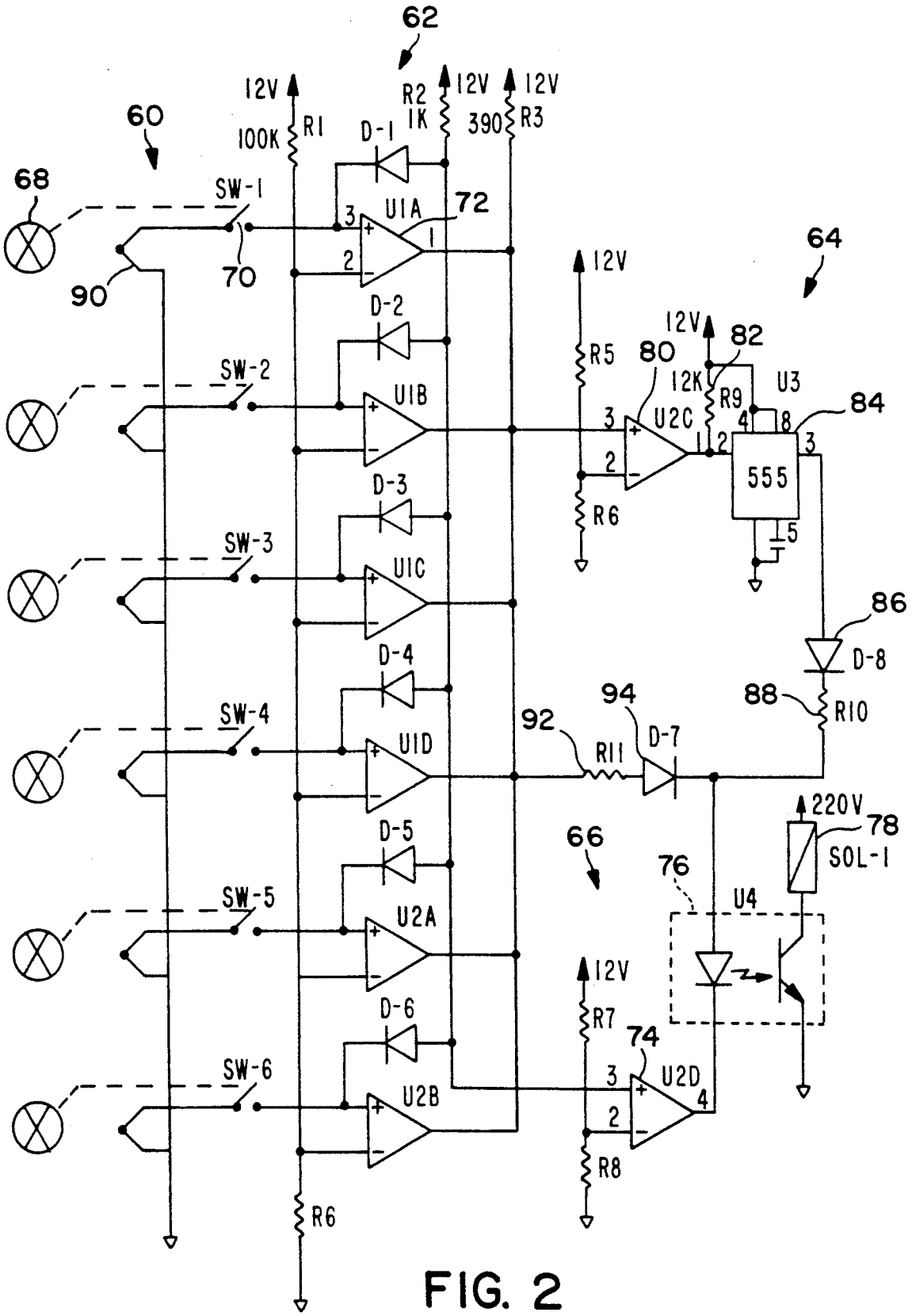

FIGS. 1A–1C taken together is a circuit diagram of a safety device for gas-fired equipment according to the present invention, and FIG. 2 is a circuit diagram of a further embodiment of a safety device for gas-fired equipment according to the present invention.

BRIEF DESCRIPTION OF THE PREFERRED EMBODIMENTS

There is shown in FIG. 1 a circuit diagram of a safety device for gas-fired equipment having a plurality of flame producing burners, wherein each of the flame producing burners is associated with a gas-tap interposed on the gas line leading from a main gas supply line to the flame producing burner.

The device comprises a power supply 10, providing, e.g., between 10 and 12 volts D. C. to selected points in the circuit designated by the indicator VCC. The device further comprises for each of the burners, a heat responsive switching circuit 12 and a secondary control circuit FIG. 1B. Still further, the device includes a central control unit 16 adapted to receive signals from each of the secondary control circuits 14 for controlling the operational state, namely, "ON" or "OFF" states of the normally closed main gas supply solenoid operated valve 18.

Referring now in detail to each of circuits 12 and 14, there is seen that the heat switching circuit 12 consists of a thermal sensor 20, such as a thermo-couple, an electronic detection unit 22 composed of a servo-amplifier 24, operating as a level detector and connected to the sensor 20. The output of the servo-amplifier 24 basically a differential amplifier equivalent to an AND gate, leads to a relay 26 operating a normally open, contactor 28, via a diode 30. The function of the diode 30 is to prevent accidental activation of the relay 26 resulting from an inductive load. When thermal sensor 20 is heated, it has a different voltage at each end. Accordingly, servo-amplifier 24 produces a "0 " logic signal. When unheated, there are two inputs of the same level and a "1 " logic output is produced.

Each of the plurality of the switching circuits is connected to a corresponding secondary control circuit 14. The latter is essentially composed of a switch 32, coupled to a gas-tap 33 associated with a specific burner of the equipment, and adapted to close upon the actuation of the gas-tap. The circuit 14 further includes an inverter 34, a timing circuit based on the resistor 36 and the capacitor 38. Resistor 40 and transistor 42 are also interconnected at the input of the inverter 34. The output of the inverter 34 leads to the respective "FAULT" input terminals of the central control unit 16 while a direct connection from the switch 32 leads to the respective O.K. input terminals of the unit 16. The input terminals of the unit 16 lead through diodes 44 and 46, respectively, resistors 48 and 50 and via transistor 52, to an opto-coupler 54 (FIG. 1C) which is responsible for the activation of the solenoid operated valve 18 of the main gas supply valve.

The operation of the safety device is as follows: Upon the lighting of one of the burners, the thermal sensor 20 located adjacent thereto, heats up and provides a voltage potential to terminal 2 of the servo-amplifier 24. The voltage potentials on the input terminals 2 and 3 of the amplifier 24 is unequal, resulting in a "0" logic (e.g. a voltage output of 0–2 volts) on the output terminal 1 thereof. The relay 26 is thus activated closing the contactor 28. The discharge of capacitor 38 (FIG. 2B) through the contactor 28 maintain the potential of the input terminal 1 of the inverter 34 at logic "0" and, hence, the potential at its output terminal 2, at logic "1" (e.g., 10–12 volts) providing, in turn, a working potential to the solenoid operated valve (FIG. 1A), via terminal O.K. 1 of unit 16.

If, however, the thermal sensor 20 did not heat up, the output 1 of servo-amplifier 34 is "high" a logic 1 and is the contactor 28 is not closed. The capacitor 38 charges up and current flows to terminal 1 of inverter 34, resulting in a logic "0" on inverter output terminal 2. This logic "0" signal passes through diode 44 (FIG. 1C) of the central control unit 16, to the transistor 52, causing cessation of its conductance and, in turn, stopping current flow to the solenoid operated valve 18. The latter closes stopping the gas flow to the equipment.

Upon the closing of a gas-tap associated with a burner, there is impressed a logic "0" on terminal O.K. 1 and a logic "1" on terminal FAULT 1 of the unit 16. Transistor 52 ceases to conduct and the opto-coupler 54 disconnects the voltage from the solenoid operated valve 18, causing its closure.

In the event that the fire was extinguished in the burner, the sensor 20 cools off, the amplifier 24 produces a logic "1" on terminal 1, deactivating the relay 26, resulting in the opening of contactor 28. The capacitor 38 charges and upon its reaching a certain potential after a predetermined period of time, a logic "1" potential is impressed on input terminal 1 of inverter 34, and a logic "0" is thus obtained at the output terminal 2 thereof and at the terminal FAULT 1 of unit 16. As explained hereinbefore, this signal causes, in turn, the closure of the solenoid operated valve 18, and the cessation of gas flow through the equipment and out the extinguished burner.

A further embodiment of a safety device for gas-fire equipment is shown in FIG. 2. Similarly to the device of FIG. 1, the device illustrated in FIG. 2 also includes a thermal switching circuit 60, a secondary control circuit 62, a timer 64 however, as a separate single circuit and a central control unit 66.

Upon the opening of the gas-tap 68 of the gas-fired equipment to light it, the mechanical switch 70 associated therewith operated by the normally closed solenoid relay 78 is also closed. Since due to unequal heating of the sensor 90 the voltage on input terminal 3 of servo-amplifier 72 is less than the voltage on terminal 2, there is formed a "0" logic on output terminal 1. This "0" logic potential is applied to input terminal 3 of differential amplifier 74 of the central control unit 66. The voltage on input terminal 2 of amplifier 74 is higher than that on its input terminal 3, resulting in a "0" logic potential on output terminal 1 thereof. This low voltage is usually not sufficient to activate the opto-coupler 76 and the opening of the, normally closed, solenoid operated valve 78. At the same instant, however, the voltage on terminal 3 of the amplifier 80 of the timer 64, is also low and the timer is actuated, in view of the fact that the its output terminal 1 becomes low and current will flow through resistor 82, to activate the conventional 555 timer circuit. The output current pulses from the 555 timer circuit thus flowing through diode 86 and resistor 88 facilitates the actuation of the opto-coupler 76 and in turn, keeps the solenoid operate valve 78 in its normally closed state to allow gas to reach the burner controlled by gas-tap 68.

When the burner is fired, the thermal sensor 90 is heated, and as described with reference to FIG. 1, there is formed at the output terminal 1 of amplifier 72 a logic "1" . The current produced thereby passes through resistor 92 and diode 94 to the opto-coupler 76 to operate same even after the termination of the operation of the timer 64.

If, however, the sensor 90 is not heated, for example, the burner is not fired, and the output 1 of amplifier 74 is at a logic 0 no current will flow through resistor 92 to the opto-coupler therefore upon the termination of the current flow from the 555 timer through resistor 88, the opto-coupler will not operate and the valve 78 will change its state from normally closed and will open. This shuts off the flow of gas to tap 68.

Upon the turning off of the gas-tap 68, the switch 70 opens and hence, the operation of the opto-coupler will depend on the open or closed states of the corresponding switches in the equipment and other operational conditions as explained hereinbefore.

While in the embodiments of FIGS. 1 and 2 there has been shown a thermo-couple as a voltage producing heat sensitive element, other types of voltage producing thermal sensors or transducers may be used as well. Likewise, the electronic component controlling the operation of the solenoid operated main valve need not necessarily be an opto-coupler and could be embodied by other corresponding components.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A safety device for gas-fired equipment having a main gas supply control valve and a plurality of gas-taps each associated with a flame-producing burner, said device comprising:

a plurality of switch means each switch means associated with a respective gas-tap and actuatable by the operation of said gas-tap, a plurality of heat responsive sensors each sensor associated with the burner of a respective gas-tap and including a switching circuit operationally connected in circuit with a secondary control circuit and a timer, and a central control unit connected in circuit for receiving control signals from the output of each of the secondary control circuits for controlling the state of said main gas supply valve, in response to the detection by a heat responsive sensor of the extinction of a flame of a burner when the gas-tap associated therewith is open said secondary control circuit connected to said sensor sends a signal to said central control unit for effecting the closing of said main gas supply valve.

2. The device as claimed in claim 1, wherein said heat responsive sensors are voltage producing type sensors.

3. The device as claimed in claim 1, wherein a said switch means is connected in circuit in a said secondary control circuit.

4. The device as claimed in claim 1, wherein a said switch means is connected in circuit between a said heat responsive sensor and its said secondary control circuit.

5. The device as claimed in claim 1, wherein each of said secondary control circuits includes a timer.

6. The device as claimed in claim 1, wherein said central control unit is connected in circuit to receive input signals from the outputs of each of said secondary control circuits.

7. The device as claimed in claim 1, wherein there is provided a single timer interconnected between said plurality of secondary control circuits and said central control unit.

8. The device as claimed in claim 1, wherein said central control unit comprises a logic component, the output of which controls the operation of an opto-coupler connected to a solenoid operated valve which forms said main gas supply control valve.

9. The device as claimed in claim 1 wherein said secondary control circuit sends said control signal after a predetermined time period.

* * * * *